US008326207B2

(12) United States Patent
Gaman et al.

(10) Patent No.: US 8,326,207 B2
(45) Date of Patent: Dec. 4, 2012

(54) SHEET TRANSPORT DEVICE AND IMAGE FORMING APPARATUS INCLUDING SAME

(75) Inventors: Yasuharu Gaman, Tokyo (JP); Nobuo Inoue, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 497 days.

(21) Appl. No.: 12/314,311

(22) Filed: Dec. 8, 2008

(65) Prior Publication Data

US 2009/0148214 A1 Jun. 11, 2009

(30) Foreign Application Priority Data

Dec. 9, 2007 (JP) ..... 2007-317793

(51) Int. Cl.
*G03G 15/00* (2006.01)
*B65H 15/00* (2006.01)
*B65H 29/00* (2006.01)

(52) U.S. Cl. ..... 399/401; 399/406

(58) Field of Classification Search ..... 399/401, 399/21, 406, 411; 400/642, 645, 624, 625; 271/272, 275, 314
See application file for complete search history.

(56) References Cited

U.S. PATENT DOCUMENTS

| | | | | |
|---|---|---|---|---|
| 4,519,198 | A * | 5/1985 | Kissel | 57/71 |
| 5,974,290 | A | 10/1999 | Inoue | |
| 5,984,305 | A | 11/1999 | Inoue | |
| 2004/0052563 | A1 * | 3/2004 | Hayamizu et al. | 399/401 |

FOREIGN PATENT DOCUMENTS

JP 11-143138 5/1999

* cited by examiner

*Primary Examiner* — Judy Nguyen
*Assistant Examiner* — Ruben Parco, Jr.
(74) *Attorney, Agent, or Firm* — Harness, Dickey & Pierce, P.L.C.

(57) ABSTRACT

A sheet transport device and an image forming apparatus that includes the sheet transport device. The sheet transport device includes a reverse-transport roller, at least one roller guide, and a shaft. The reverse-transport roller is provided to a diverging point of a sheet reversing portion from which a recording medium enters or exits and is configured to transport the recording medium to the sheet reversing portion. At least one roller guide is provided in a vicinity of an end face of at least one side of the reverse-transport roller and is configured to prevent the reverse-transport roller from contacting the recording medium when reversing the recording medium. The reverse-transport roller and the roller guide are disposed on the shaft. Friction of a peripheral surface of the roller guide is configured to be substantially less than that of the recording medium.

15 Claims, 8 Drawing Sheets

SHEET TRANSPORT DEVICE AND IMAGE FORMING APPARATUS INCLUDING SAME

CROSS-REFERENCE TO RELATED APPLICATIONS

This patent application is, based on and claims priority pursuant to 35 U.S.C. §119 from Japanese Patent Application No. 2007-317793 filed on Dec. 9, 2007 in the Japan Patent Office, the entire contents of which are hereby incorporated herein by reference.

BACKGROUND OF THE INVENTION

1. Field of the Invention

Exemplary aspects of the present invention generally relate to an image forming apparatus, such as a copier, a facsimile machine, a printer, or a digital multi-functional system including a combination thereof, and more particularly, to a sheet transport device that transports a recording medium such as a recording sheet.

2. Description of the Background Art

In general, image forming apparatuses, such as printers, facsimile machines, and copiers have a similar if not the same configuration as that illustrated in FIG. 1. FIG. 1 is a cross-sectional view illustrating a generally known image forming apparatus and a sheet transport path for a recording medium that includes but is not limited to a paper sheet (hereinafter simply referred to as a recording sheet).

When an image is formed on one side of a recording sheet P, the recording sheet P stacked in a sheet feed unit 3 is fed to an image forming unit 2. In the image forming unit 2, the image is transferred onto one side of the recording sheet P. Subsequently, the image is fixed by a fixing device 4, and then discharged to a sheet reversing portion, for example, a sheet reversing device 6.

In the sheet reversing device 6 serving as the sheet reversing portion, the recording sheet P is inverted. Then, the recording sheet P is discharged through a sheet discharge unit 8.

In this type of image forming apparatus, when an image is formed on both sides of the recording sheet P, the recording sheet P stacked in the sheet feed unit 3 is fed to the image forming unit 2 in which the image is transferred on one side of the recording sheet P.

Subsequently, the image is fixed on the recording sheet P in the fixing unit 4 and discharged to the sheet reversing device 6 in which the recording sheet P is inverted. The recording sheet P is then supplied again to the image forming unit 2 through a duplex sheet feed path 7. In the image forming unit 2, the image is formed on the other side of the recording sheet P.

When, on the other hand, an image is formed on only one side of the recording sheet P, the recording sheet P stacked in the sheet feed unit 3 is supplied to the image forming unit 2, and the image is transferred onto one side of the recording sheet 2. Subsequently, the image is fixed on the recording sheet P in the fixing unit 4, and then discharged through the sheet discharge unit 8.

It is to be noted that, in FIG. 1, reference numeral 5 refers to a sheet delivery unit, 41 refers to a pair of sheet transport rollers, 16 refers to a discharge-direction switch unit, 15 refers to a turn roller, and 30 refers to a sheet transport direction switch unit.

Referring now to FIG. 2, there is provided a schematic diagram illustrating the sheet reversing device 6 including reverse-transport rollers and peripheral components thereof in the image forming apparatus of FIG. 1.

After the image is transferred and fixed on the recording sheet P, the recording sheet P is transported to the sheet reversing device 6.

The sheet reversing device 6 includes reverse-transport rollers 90, sheet transport claws 100, and a reverse table 11. In the sheet reversing device 6, the reverse-transport rollers 90 and the sheet transport claws 100 draw out and send the recording sheet P to the reverse table 11.

With reference to FIG. 3, a description will be provided of an example of transport of the recording sheet P. In FIG. 3, each of the sheet transport claws 100 having a comb-like shape is alternately aligned with each of the reverse-transport rollers 90 on a shaft 190.

As illustrated in FIG. 3, the reverse-transport rollers 90 and the sheet transport claws 100 ruffles the recording sheet P, generating resilience and thereby pressing the recording sheet P against the reverse-transport rollers 90. Accordingly, the recording sheet P is transported reliably to the reverse table 11.

Referring now to FIG. 4, there is provided a side view illustrating the related art sheet transport claws 100 and the related art reverse-transport roller 90. As illustrated in FIG. 4, when the sheet transport claws 100 and the reverse-transport rollers 90 transport the recording sheet P, a spring 23 adjusts pressure against the recording sheet P.

In FIG. 4, a guide member 22*a* guides the recording sheet P as the recording sheet P advances into the reverse-transport rollers 90.

A pair of jogger fences 12 is provided on the reverse table 11. The pair of jogger fences 12 aligns and adjusts a position of the recording sheet P, and is movable in a vertical direction on the plane of FIG. 2.

When the recording sheet P is transported onto the reverse table 11, the pair of jogger fences 12 waiting at a position outside a sheet width travels to a position of guiding the recording sheet P from both sides thereof. While the pair of jogger fences 12 guides the recording sheet P, an invert driven roller 13 that has been moved substantially above descends to an invert drive roller 14 to contact and invert the recording sheet P. The recording sheet P is then transported to the turn roller 15.

It is to be noted that, in FIG. 2, reference number 34 refers to a separation claw, 35 refers to an intermediate inversion roller, and 36 and 37 refer to driven rollers.

Subsequently, the invert driven roller 13 rises so as to separate from the invert drive roller 14, thereby releasing the recording sheet P. When an image is formed on one side of the recording sheet P, the recording sheet P is transported to the sheet discharge unit 8 and discharged outside the image forming apparatus 1.

By contrast, when an image is formed on both sides of the recording sheet P, the turn roller 15 turns the recording sheet P and transports the recording sheet P to the duplex sheet feed path 7. Subsequently, the duplex sheet feed path 7 transports the recording sheet P to relay rollers 26, 27, and 28, thereby feeding the recording sheet P to the image forming unit 2 again.

FIG. 5 is a perspective view illustrating the related art sheet transport device 500 including the reverse-transport rollers 90 and the sheet transport claws 100. FIG. 6 is a cross-sectional view illustrating the related art reverse-transport roller 90 and the related art sheet transport claws 100 of FIG. 5 when the recording sheet P is transported to the reverse-transport roller 90. FIG. 7 is a cross-sectional view illustrating the reverse-transport roller 90 and the sheet transport claws 100 when the recording sheet P is being inverted.

As illustrated in FIG. 5, the reverse-transport rollers 90 rotate in one direction indicated by arrow C for the following reasons. For example, time loss caused by a recording sheet P being transported to the reverse table 11 and a recording sheet P2 being transported out of the reverse table 11 passing each other as illustrated in FIG. 7 can be reduced.

Further, in order to simplify a drive mechanism, the reverse-transport rollers 90 are configured to rotate in one direction so that the reverse-transport rollers 90 can be operated by a common motor that operates also other rollers.

Further, in order to create a ruffle shape on the recording sheet P as illustrated in FIG. 3, the sheet transport claws 100 are urged upward in a manner as illustrated in FIG. 4. The tip of each of the sheet transport claws 100 is disposed such that the tip thereof is positioned more inward than the peripheral surface of the reverse-transport rollers 90. In other words, a portion 90*a* illustrated in FIG. 7 of the reverse-transport rollers 90 projects substantially below the sheet transport claws 100.

As illustrated in FIG. 6, when the recording sheet P1 is transported onto the sheet reverse table 11, the recording sheet P1 presses down the sheet transport claws 100 so that the portion 90*a* is not generated or a relatively small amount of the portion 90*a* is generated. When the portion 90*a* is generated slightly, transport of the recording sheet P is not adversely affected.

However, when the recording sheet P is inverted, a corner of the recording sheet P is curled as illustrated in FIG. 5 and the curled tip portion P1 of the recording sheet P contacts the reverse-transport roller 90 rotating in an opposite direction as a transport direction indicated by arrow X.

In particular, the curled tip portion P1 of the recording sheet P contacts the portion 90*a* projecting below the sheet transport claw 100, causing the curled tip portion P1 to curl even more and resulting in paper jams and damage to the recording sheet P, for example, undesirable folding at the corner of the recording sheet P.

Further, when the image forming apparatus 1 fixes the image using heat, deformation of the recording sheet P such as curling tends to be aggravated after fixing process. In addition, such deformation of the recording sheet P occurs as the image is developed with toner.

According to the related art sheet transport device, such a reverse-transport roller is driven by a dedicated drive source, or is driven by a drive source of the sheet feed unit that is different from a drive source for a sheet transport device for reading operation, thereby increasing a number of drive sources employed in the image forming apparatus, and thus increasing the cost of the image forming apparatus as a whole.

SUMMARY OF THE INVENTION

Illustrative embodiments of the present invention provide a sheet transport device in which paper jams and/or damage to a recording sheet can be reduced, if not prevented entirely, with a relatively simple and low-cost structure, and an image forming apparatus including the sheet transport device.

According to one preferred embodiment, the sheet transport device includes a reverse-transport roller and at least one roller guide, and a shaft. The reverse-transport roller is provided to a diverging point of a sheet reversing portion from which a recording medium including a paper sheet either enters or exits and configured to transport a recording sheet to the sheet reversing portion. At least one roller guide is provided in a vicinity of an end face of at least one side of the reverse-transport roller and configured to prevent the reverse-transport roller from contacting the recording medium when reversing the recording medium. The reverse-transport roller and the roller guide are disposed on the shaft. Friction of a peripheral surface of the roller guide is configured to be less than that of the recording medium.

According to another preferred embodiment, a sheet transport device includes a plurality of reverse-transport rollers, at least one roller guide, and a shaft. The plurality of the reverse-transport rollers is provided to a diverging point of a sheet reversing portion from which a recording medium such as a paper sheet either enters or exits and is configured to transport the recording medium to the sheet reversing portion. At least one roller guide is provided in a vicinity of an end face of at least one side of at least an outermost-one of the plurality of the reverse-transport rollers in a shaft direction of the reverse-transport rollers and configured to prevent the reverse-transport rollers from contacting the recording medium when reversing the recording medium. The reverse-transport rollers and the roller guide are disposed on the shaft. Friction of a peripheral surface of the roller guide is less than that of the recording medium.

According to still another preferred embodiment, an image forming apparatus for forming an image includes an image bearing member, a developing device, a transfer device, a fixing device, and the sheet transport device. The image bearing member is configured to bear an electrostatic latent image on a surface thereof. The developing device is configured to develop the electrostatic latent image formed on the image bearing member using toner to form a toner image. The transfer device is configured to transfer the toner image onto the image bearing member. The fixing device is configured to fix the toner image. The sheet transport device includes the reverse-transport roller and the roller guide.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
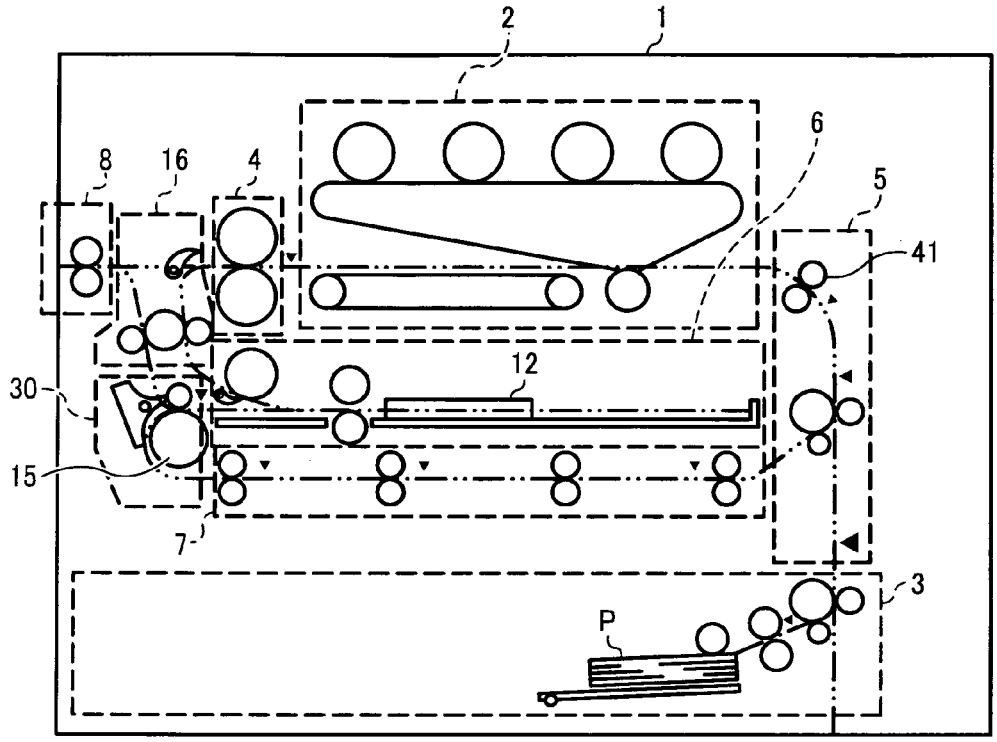
FIG. 1 RELATED ART
FIG. 1 is a schematic diagram illustrating an example of a generally known image forming apparatus.
Figure 2:
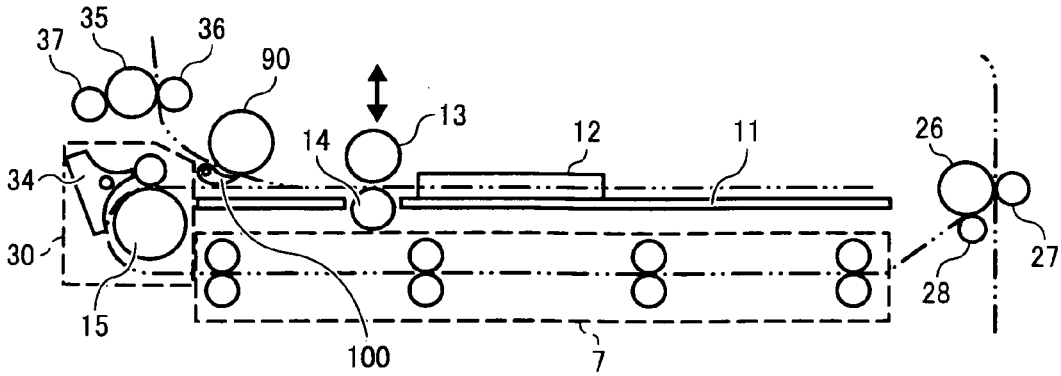
FIG. 2 RELATED ART
FIG. 2 is a schematic diagram conceptually illustrating a related art sheet reversing portion and peripheral components thereof in the image forming apparatus of FIG. 1.
Figure 3:
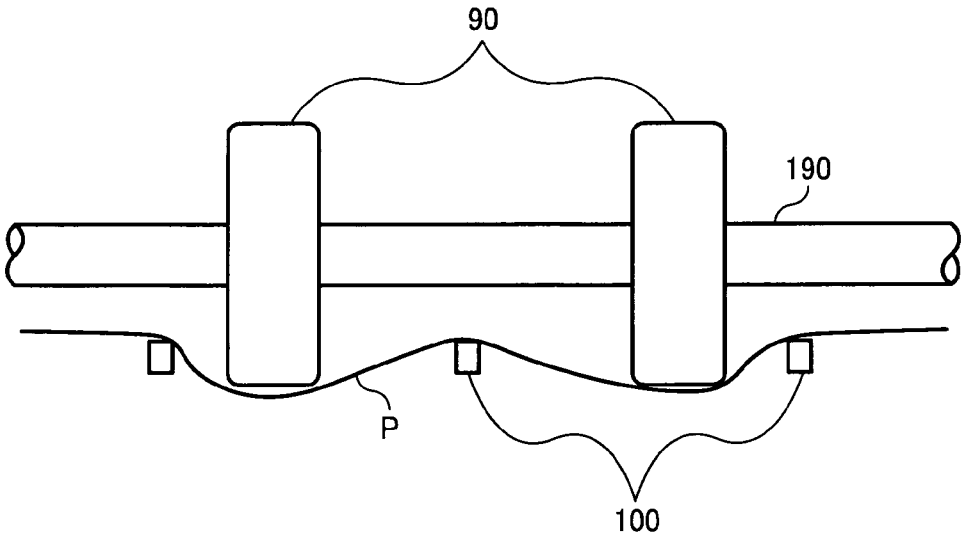
FIG. 3 RELATED ART
FIG. 3 is a schematic diagram conceptually illustrating transport of a recording sheet by forming a ruffle shape on the recording sheet.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 11:
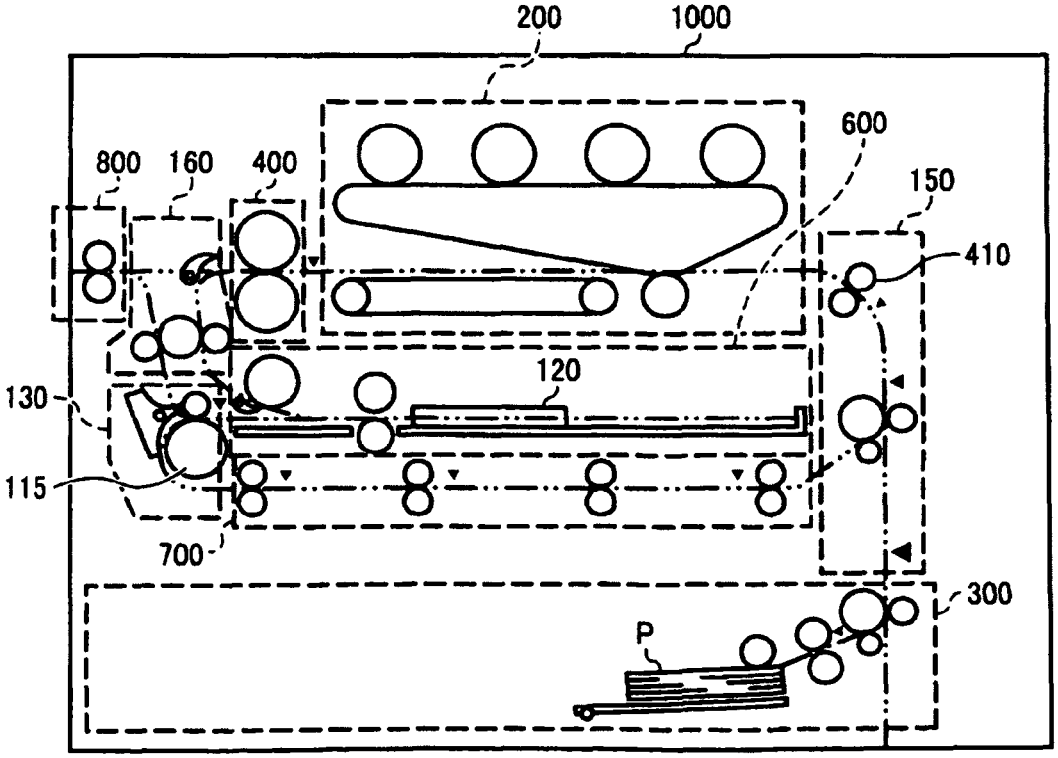
FIG. 11 is a schematic diagram illustrating an example of an image forming apparatus in which the sheet transport device according to the illustrative embodiment can be employed.

Referring now to the drawings, wherein like reference numerals designate identical or corresponding parts throughout the several views, and initially to FIG. 11, one example of an image forming apparatus according to an illustrative embodiment of the present invention is described.

Referring now to FIG. 11, there is provided a schematic diagram illustrating an image forming apparatus 1000 in which a sheet transport device 50 according to the illustrative embodiment can be employed.

The image forming apparatus. 1000 in FIG. 11 has a configuration similar to, if not the same as, that of a generally-known image forming apparatus, except for the later-described sheet transport device 50 of the illustrative embodiment.

In FIG. 11, when an image is formed on only one side of a recording sheet P, the recording sheet P stacked in a sheet feed unit 300 is fed to an image forming unit 200. In the image forming unit 200, the image is transferred onto one side of the recording sheet P. Subsequently, the image is fixed by a fixing device 400, and then discharged to a sheet reversing device 600.

In the sheet reversing device 600, the recording sheet P is inverted. Then, the recording sheet P is discharged through a sheet discharge unit 800.

By contrast, when an image is formed on both sides of the recording sheet P in such an image forming apparatus, the recording sheet P stacked in the sheet feed unit 300 is fed to the image forming unit 200 in which the image is transferred on one side of the recording sheet P.

Subsequently, the image is fixed in the fixing unit 400 and discharged to the sheet reversing device 600 in which the recording sheet P is inverted. The recording sheet P is then supplied again to the image forming unit 200 through the duplex sheet feed path 700. In the image forming unit 200, the image is formed on the other side of the recording sheet P.

When, on the other hand, the image is formed on only one side of the recording sheet P, not on both sides thereof, the recording sheet P stacked in the sheet feed unit 300 is supplied to the image forming unit 200, and the image is transferred onto one side of the recording sheet 200.

Subsequently, the image is fixed on the recording sheet P in the fixing unit 400, and then discharged through the sheet discharge unit 800.

It is to be noted that, in FIG. 11, a reference numeral 150 refers to a sheet transport path, 410 refers to a pair of sheet transport rollers, 160 refers to a discharge-direction switch unit, 115 refers to a turn roller, 120 refers to a pair of jogger fences that align and adjust a position of the recording sheet P, and 130 refers to a transport direction switch unit.

Figure 8A:
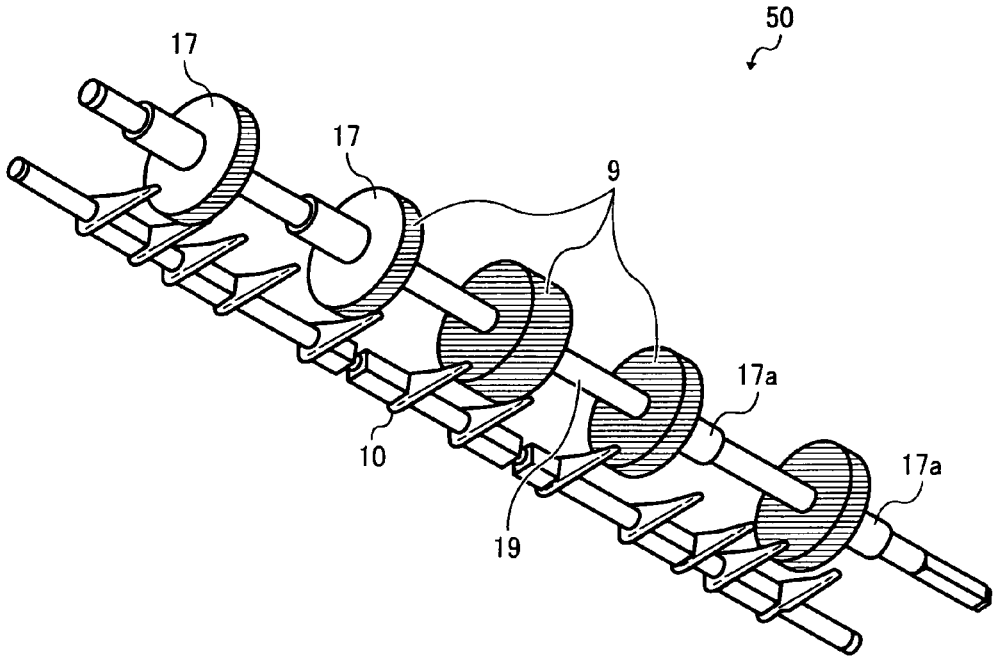
FIG. 8A is a perspective view illustrating a sheet transport device including reverse-transport rollers and roller guides according to an illustrative embodiment of the present invention.
Figure 8B:
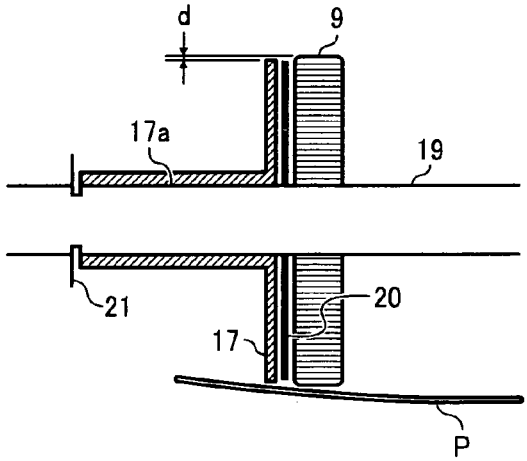
FIG. 8B is an enlarged cross-sectional view illustrating the reverse-transport roller and the roller guide of FIG. 8A according to an illustrative embodiment of the present invention.

Referring now to FIGS. 8A and 8B, there are provided schematic diagrams illustrating a sheet transport device 50 including reverse-transport rollers 9 and roller guides 17, according to an illustrative embodiment of the present invention.

Figure 8C:
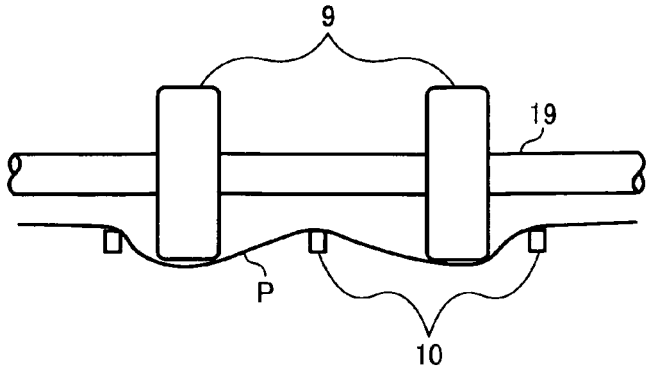
FIG. 8C is a schematic diagram conceptually illustrating transport of the recording sheet by forming a ruffle shape on the recording sheet.

FIG. 8A is a perspective view illustrating the sheet transport device 50 including the reverse-transport rollers 9 and the roller guides 17, according to an illustrative embodiment. FIG. 8B is an enlarged cross-sectional view illustrating the reverse-transport rollers 9 and the roller guides 17 of the sheet reversing device 6 according to the illustrative embodiment. FIG. 8C is a schematic diagram conceptually illustrating transport of a recording sheet by forming a ruffle shape on the recording sheet P.

As illustrated in FIG. 8A, the sheet transport device 50 includes the reverse-transport rollers 9 and the roller guides 17. The sheet transport device 50 is provided to a diverging point of the sheet reversing device 6 from which the recording sheet P enters or exits.

Each of the roller guides 17 is formed of low frictional material that provides good slidability. The roller guide 17 and the reverse-transport roller 9 are coaxially provided to a shaft 19. However, the roller guide 17 is rotatable in both forward and backward directions. In other words, the roller guide 17 is configured not to rotate together with the reverse-transport roller 9. The roller guide 17 is rotatable independent of rotation of the reverse-transport roller 9.

The roller guide 17 is provided in the vicinity of the reverse-transport roller 9. In particular, the roller guide 17 is provided in the vicinity of an end face of at least one side of the reverse-transport roller 9, or, alternatively, in the vicinity of an end face of both sides of the reverse-transport roller 9.

Between the reverse-transport roller 9 and the roller guide 17, a slide sheet 20 serving as a slide member is coaxially provided on the same shaft, that is, the shaft 19.

The slide sheet 20 is formed of a low frictional sheet member so as to provide relatively good slidability. A thickness thereof is between approximately 0.1 mm and 0.2 mm, for example. The thickness of the sheet member 20 is preferably as thin as possible.

The slide sheet 20 is movable independent of the reverse-transport roller 9 and the roller guide 17. However, there may be a case in which the slide sheet 20 contacts the reverse-transport roller 9 and/or the roller guide 17, or both so that the slide sheet 20 may rotate together with the reverse-transport roller 9 and/or the roller guide 17. In such a case, however, there is no significant problem.

Further, alternatively, the slide sheet 20 may not be provided, depending on the material employed for the reverse-transport roller 9 and the roller guide 17.

It is to be noted that when the slide sheet 20 is too thick, it may be difficult to transport the recording sheet P in a manner as illustrated in FIG. 8C. In FIG. 8C, the reverse-transport rollers 9 and the sheet transport claws 10 cause the recording sheet P to intentionally ruffle generating resilience and thereby pressing against the reverse-transport rollers 9. Accordingly, the recording sheet P is transported reliably to the reverse table 11.

According to the illustrative embodiment, as illustrated in FIG. 8A, the roller guide 17 is provided to each of the reverse-transport rollers 9 disposed in the shaft direction, except for the reverse-transport roller 9 disposed in the center. Alternatively, the roller guide 17 may be provided only to the reverse-transport rollers 9 located at substantially outer sides in the shaft direction so as to be able to transport the end portion of various sizes of the recording sheet P in the shaft direction thereof. In other words, the roller guide 17 is provided to the reverse-transport rollers 9 that are disposed in the vicinity of the end portions of the recording sheet P.

It is to be noted that the location and the structure of the roller guides 17 are not limited to the above-described configuration. In particular, when the recording sheet P is relatively large, the size of curling that occurs on the recording sheet P tends to be relatively large. In such a case, the roller guide 17 may be provided only to the reverse-transport rollers 9 that are located in the vicinity of the end portions of the large recording sheet P.

Accordingly, the cost can be reduced, as compared with providing the roller guides 17 to not only the reverse transport rollers 9 located in the vicinity of the end portions of the recording sheet P, but other reverse-transport rollers 9.

As illustrated in FIG. 8B, an external diameter of the roller guide 17 is configured to be slightly less than an external diameter of the reverse-transport roller 9. The external diameter of the roller guide 17 is smaller than the external diameter of the reverse-transport roller 9 by an amount d of approximately 0.1 mm, for example.

Accordingly, merely the peripheral surface of the reverse-transport roller 9 that is a surface that needs to contact the recording sheet P to transport the recording sheet P comes into contact with the recording sheet P, thereby preventing unnecessary contact with the recording sheet P.

The roller guide 17 includes a hole in substantially the center thereof through which the shaft 19 penetrates. The roller guide 17 is rotatably mountable to the shaft 19 through the hole.

In order to reduce, if not prevent entirely, rattling or shaking of the roller guide 17 around the shaft 19, a shaft bearing 17*a* is provided to the roller guide 17. Typically, the shaft bearing 17*a* is relatively long, between approximately 15 mm and 20 mm, depending on the size of the image forming apparatus. However, the length of the shaft bearing 17*a* is not limited thereto. In addition, the shaft bearing 17*a* has a cylindrical shape.

The shaft 19 includes grooves to which stoppers 21 are mounted so as to prevent the shaft bearing 17*a* of the roller guide 17 from shifting in the shaft direction of the shaft 19.

When the roller guide 17 includes a relatively long mounting portion, that is, the shaft bearing 17*a* to be mounted to the shaft 19, the position of the roller guide 17 can be stabilized, thereby maintaining reliably sheet transport ability.

In addition, alternatively, a portion of the reverse-transport roller 9 rotatably mountable to the shaft 19 may include a bearing so as to enhance smooth rotation. Generally, in an image forming apparatus, curling tends to occur easily on the recording sheet P due to the fixing process using heat and also a toner image.

Thus, according to the illustrative embodiments described above, one or a combination of the above-described embodiments can reduce, if not prevent entirely, damage to the recording sheet such as paper jams and undesirable folding at the corner of the recording sheet P due to curling on the recording sheet P, thereby reliably maintaining better sheet transport ability.

When the recording sheet P is transported while the corner portion P1 is curled, the curling thereof is aggravated according to the related art sheet transport unit 500. As a result, the related art reverse-transport rollers 90 are prevented from properly contacting the recording sheet P to transport the recording sheet P.

By contrast, according to the illustrative embodiment, the roller guides 17 are provided to the sheet transport unit 50 to operate such that the curled portion of the corner portion P1 of the recording sheet P is prevented from unnecessary contact with the reverse-transport rollers 9.

Figure 9:
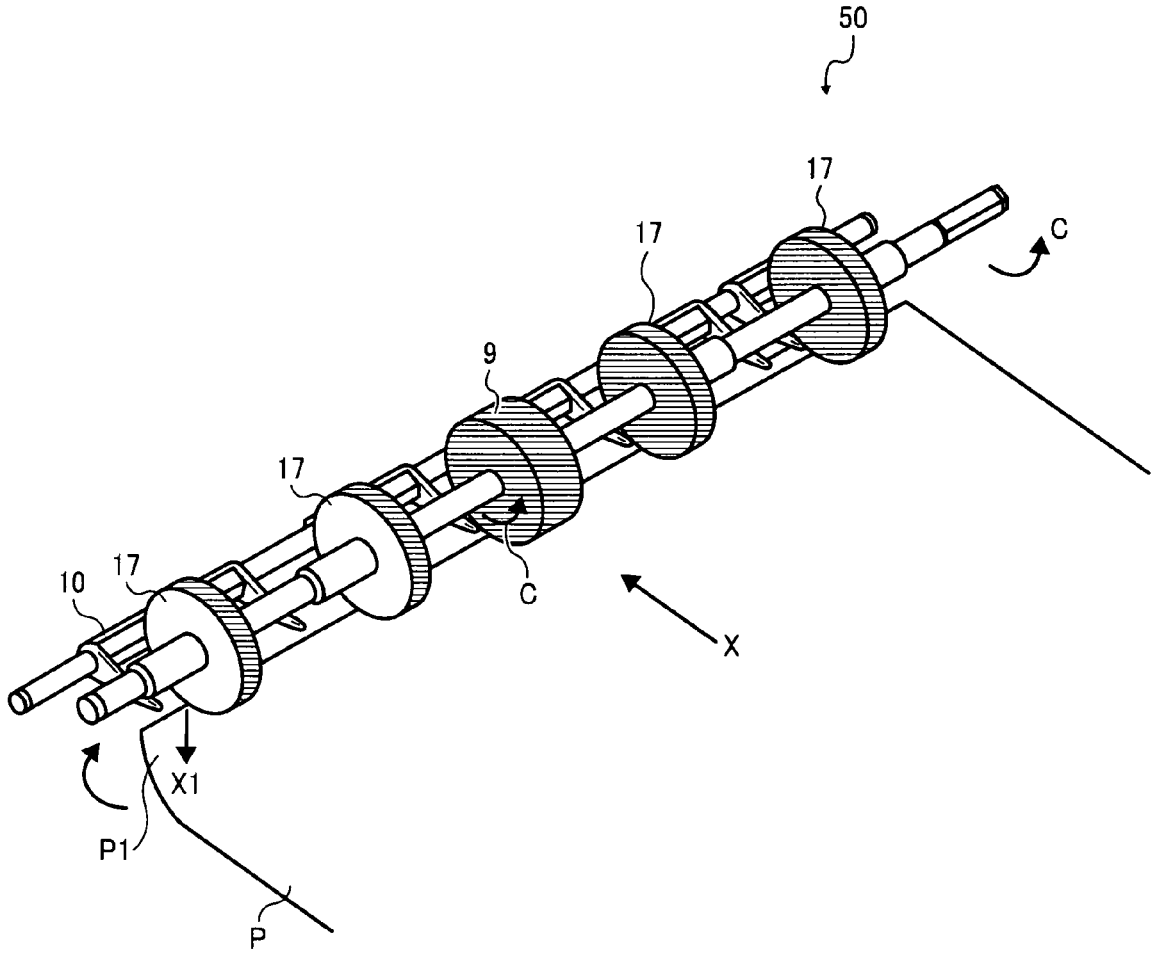
FIG. 9 is a schematic diagram illustrating start of reversing of the recording sheet when using the sheet transport device of FIG. 8A according to an illustrative embodiment of the present invention.

Referring now to FIG. 9, there is provided a schematic diagram illustrating a reverse movement of the recording sheet P according to the illustrative embodiment.

When the recording sheet P is inverted and the corner portion P1 of the recording sheet P is curled as illustrated in FIG. 9, there is a case in which the edge of the corner portion P1 may inadvertently contact the roller guide 17.

Since the roller guides 17 are made of relatively low frictional material as described above, when the corner portion P1 of the recording sheet P contacts the ridge of the roller guide 17, the roller guide 17 suppresses movement of the recording sheet P curling upward. As a result, a reaction force X1, that is, a downward force against the force of curling upward, acts on the corner portion P1 of the recording sheet P as illustrated in FIG. 9. Accordingly, regardless of rotation of roller guides 17, curling of the recording sheet P is suppressed.

Figure 10:
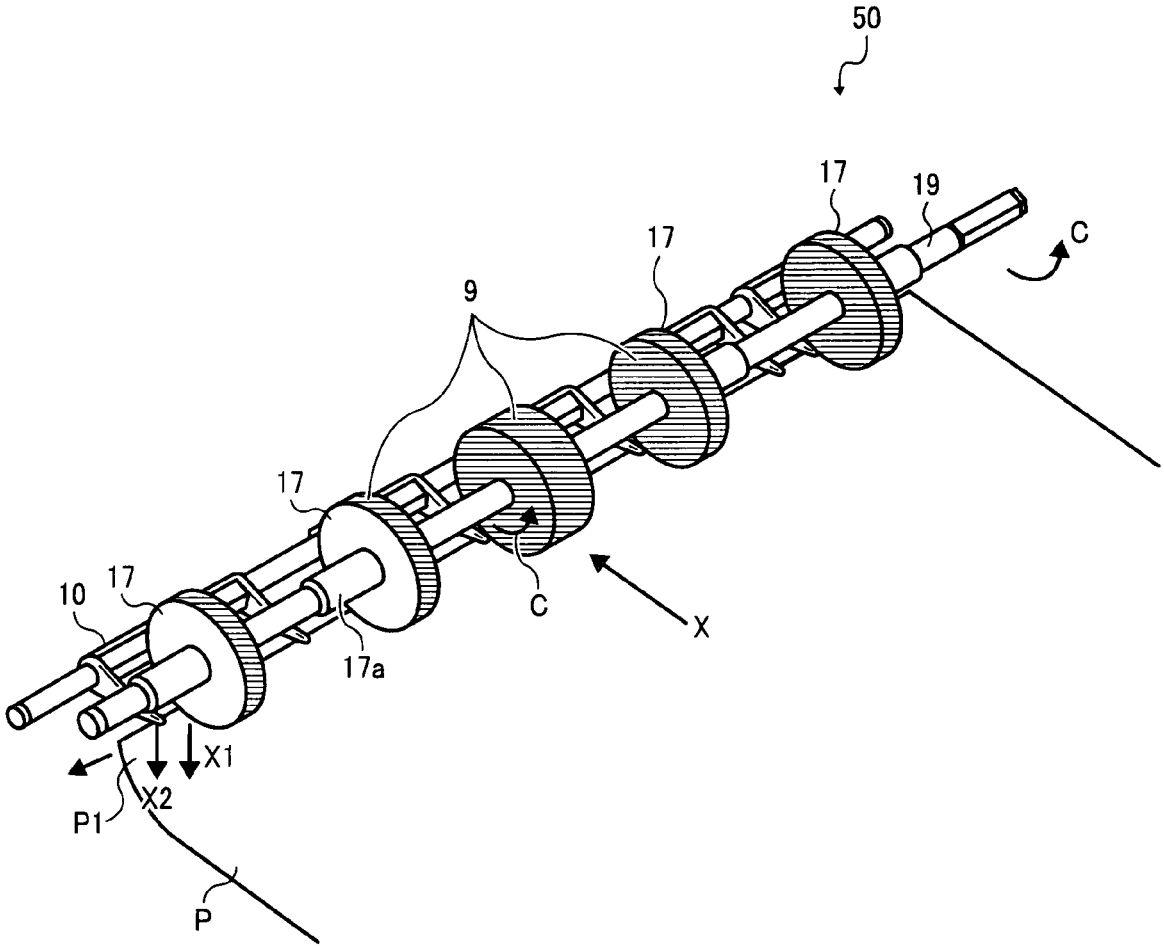
FIG. 10 is a schematic diagram illustrating the recording sheet after reversing operation of the recording sheet is started when using the reverse-transport rollers and the roller guides of FIG. 8 according to an illustrative embodiment of the present invention.

As illustrated in FIG. 10, even if the upper surface of the recording sheet P contacts the roller guide 17 inadvertently, the recording sheet P slidingly advances in the transport direction along the ridge of the roller guide 17 without rolling, preventing the recording sheet P from getting drawn underneath the tip of the sheet transport claws 10 and thus preventing curling and/or aggravation of rolling of the recording sheet P. Consequently, the recording sheet P is transported to a duplex sheet feed path without the trouble described above, and transport ability can be enhanced.

Further, when the upper surface of the recording sheet P contacts not only the ridge of the roller guide 17, but also the bottom end of the sheet transport claws 10, in addition to the reaction force X1 of the roller guides 17, a reaction force X2, that is, a downward force against the corner portion P1 of the recording sheet P pushing up the bottom end of the sheet transport claws 10, is exerted on the surface of the recording sheet P. As a result, the recording sheet P can be transported smoothly to the duplex feed path.

Figure 4:
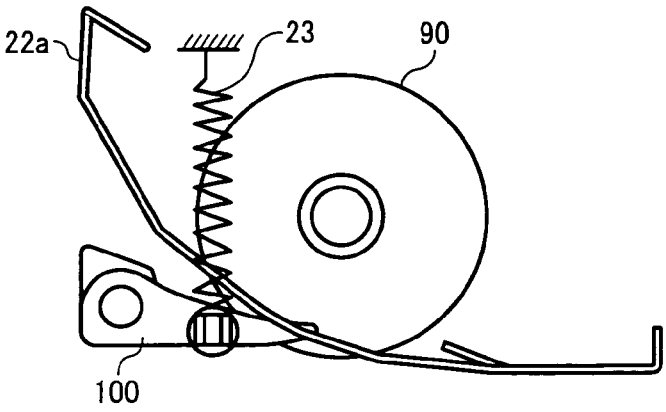
FIG. 4 RELATED ART
FIG. 4 is a cross-sectional view illustrating a related art sheet transport claw and a related art reverse-transport roller.
Figure 5:
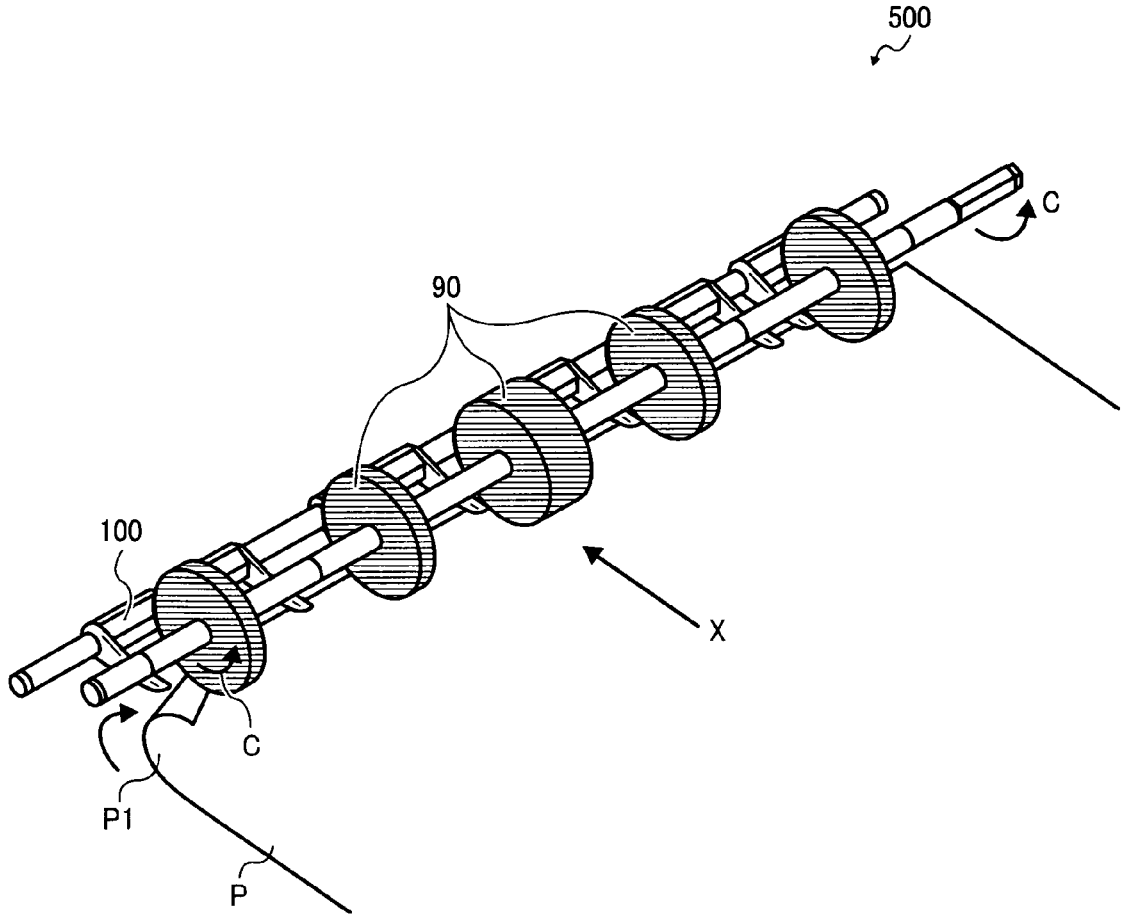
FIG. 5 RELATED ART
FIG. 5 is a perspective view illustrating a related art sheet transport device including the sheet transport claws and the reverse-transport rollers of FIG. 4.
Figure 6:
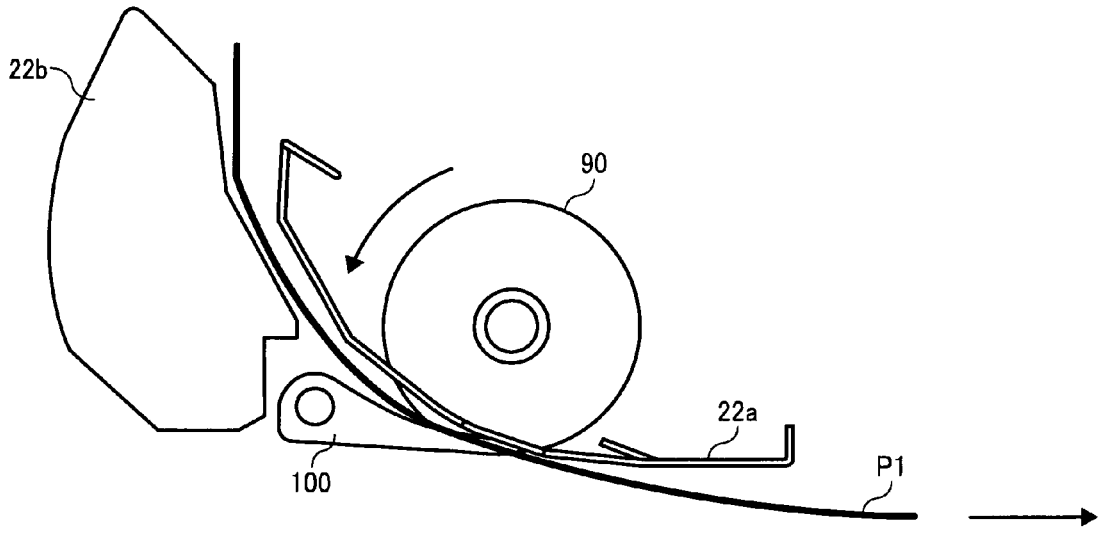
FIG. 6 RELATED ART
FIG. 6 is a conceptual diagram for explaining transport of the recording sheet when using the sheet transport claws and the reverse-transport rollers of FIG. 4.
Figure 7:
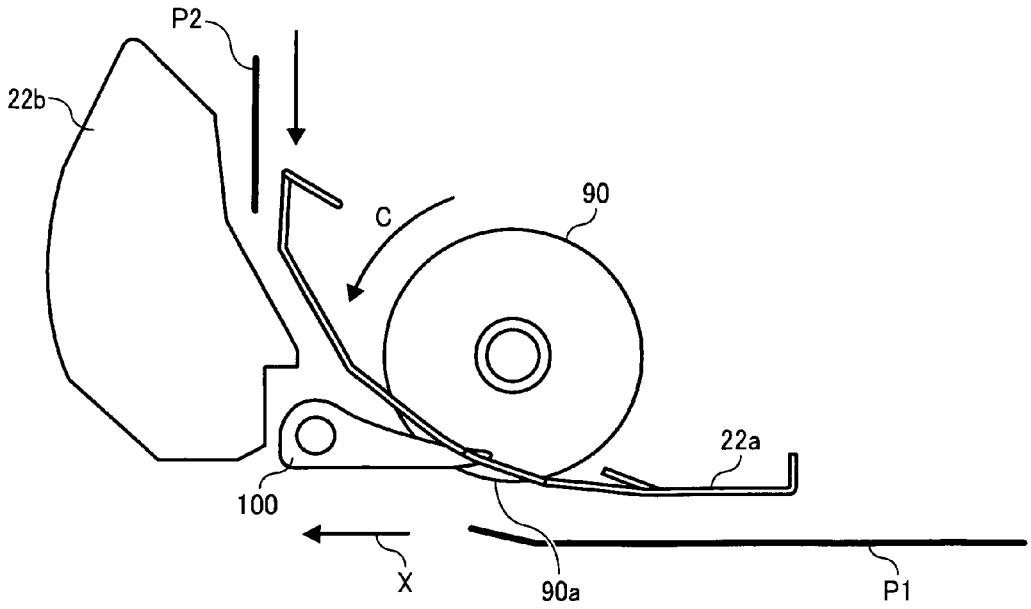
FIG. 7 RELATED ART
FIG. 7 is a conceptual diagram for explaining reversing the recording sheet when using the sheet transport claws and the reverse-transport rollers of FIG. 4.

It is to be noted, however, that since the sheet transport claws 10 are urged upward by a spring similar to the spring 23 of the related art sheet transport claws 100 illustrated in FIG. 4, the reaction force X2, that is, the downward force, is relatively small.

Deformation of the recording sheet P, similar to rolling of the leading edge of the recording sheet P in the transport direction thereof, may occur not only at the leading edge of the recording sheet P, but also at places other than the leading edge of the recording sheet P, for example, the center portion of the recording sheet P.

According to the illustrative embodiment, the roller guides 17 are provided to not only the reverse-transport rollers 9 located in the vicinity of the end portions of the recording sheet P, but also to the reverse-transport rollers 9 located at substantially the center portion of the recording sheet P.

Accordingly, the recording sheet P can be transported smoothly to the duplex sheet feed path 7 in a manner described above. Further, with this configuration, even if curling of the recording sheet P is relatively large, undesirable folding at the corner portion of the recording sheet P can be reliably prevented at relatively low cost.

According to the illustrative embodiment, since the roller guide 17 is rotatable in both forward and backward directions and independent of rotation of the reverse-transport roller 9, even if the recording sheet P contacts the roller guide 17, the roller guide 17 can still rotate freely, thereby remaining able to guide the recording sheet P with less resistance relative to the recording sheet P.

Thus, even if curling of the recording sheet P is relatively large, paper jams and/or undesirable folding of the recording sheet can be prevented, thereby providing better sheet transport ability at relatively low cost.

According to the illustrative embodiment, the relatively thin slide sheet 20 is provided between the roller guide 17 and the reverse-transport roller 9 to prevent the roller guide 17 and the reverse-transport roller 9 from contacting each other.

With this configuration, the roller guide 17 can rotate smoothly, thereby reducing resistance against the recording sheet P. Transport trouble such as paper jams and/or undesirable folding due to curling of the recording sheet P can be reliably prevented as well.

Further, with this configuration, a relatively small gap can be formed between the roller guide 17 and the reverse-transport roller 9 with ease and at low cost. Accordingly, the transport ability can be enhanced with a relatively simple structure and at low cost.

According to the illustrative embodiment, the external diameter of the roller guide 17 is configured to be substantially the same or slightly less than the external diameter of the reverse-transport roller 9, and the roller guide 17 is relatively thin. Accordingly, the space that the roller guides 17 occupies can be reduced, thereby preventing unnecessary contact with the recording sheet P, thus achieving better sheet transport ability at relatively low cost.

When such a sheet transport device including the roller guide described above is employed in the image forming apparatus, for example, the image forming apparatus 1000, better sheet transport ability can be achieved at relatively low cost and with a relatively small structure even after image transfer and/or fixing operation during which curling may easily occur to the recording sheet.

The foregoing pertains to the illustrative embodiment of the present invention. However, the configuration of the sheet transport device is not limited to the configuration described above. Alternatively, although not illustrated, the roller guide 17 can be provided at both sides of each of the reverse-transport roller 9.

According to the illustrative embodiment, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A sheet transport device, comprising:

at least one transport roller provided to a diverging point of a sheet reversing portion from which a recording medium enters or exits, configured to transport the recording medium to the sheet reversing portion;

at least one roller guide provided in a vicinity of an end face of at least one side of the at least one transport roller, configured to suppress a curled portion of a corner portion of the recording medium from contacting the at least one transport roller when reversing the recording medium; and a shaft on which the at least one transport roller and the at least one roller guide are disposed, wherein rotation of the at least one transport roller does not change during a reverse transport of the recording medium to the sheet reversing portion, friction between a peripheral surface of the at least one roller guide and the recording medium is lower than the friction between the at least one transport roller and the recording medium, the at least one roller guide and the at least one transport roller are coaxially provided to a same shaft, and the at least one roller guide is rotatable in both forward and reverse directions, independent of a rotation of the at least one transport roller, the at least one roller guide is provided between a plurality of transport rollers and is formed of a low frictional material so as to provide slidability, and a slide member provided between the at least one roller guide and the at least one transport roller to prevent the at least one roller guide and the at least one transport roller from contacting each other.

2. The sheet transport device according to claim 1, further comprising sheet transport claws arranged between said plurality of transport rollers and at an inner side thereof in a radial direction thereof.

3. The sheet transport device according to claim 1, wherein the slide member is formed of a thin sheet member having a thickness less than a thickness of the at least one transport roller.

4. The sheet transport device according to claim 1, wherein the at least one roller guide is associated with the at least one transport roller that is located in a vicinity of an end portion of the recording medium in a width direction thereof.

5. The sheet transport device according to claim 1, wherein the at least one roller guide is associated with the at least one transport roller that is disposed in a vicinity of a location where deformation of the recording medium is to occur.

6. The sheet transport device according to claim 1, wherein an outer diameter of the at least one roller guide is substantially the same as or slightly smaller than an outer diameter of the at least one transport roller that is disposed in the vicinity of the at least one roller guide.

7. The sheet transport device according to claim 1, wherein a mounting portion of the at least one roller guide, that is mounted to the shaft, is an extended cylinder in shape.

8. An image forming apparatus for forming an image, comprising:

an image bearing member configured to bear an electrostatic latent image on a surface thereof;

a developing device configured to develop the electrostatic latent image formed on the image bearing member using toner to form a toner image;

a transfer device configured to transfer the toner image onto the image bearing member;

a fixing device configured to fix the toner image; and a sheet transport device, the sheet transport device including:

a transport roller provided to a diverging point of a sheet reversing portion where a recording medium enters or exits, configured to transport the recording medium to the sheet reversing portion;

at least one roller guide provided in a vicinity of an end face of at least one side of the transport roller, configured to suppress the transport roller from contacting a curled portion of a corner portion of the recording medium when reversing the recording medium; and a shaft to which the transport roller and the at least one roller guide are disposed, wherein rotation of the transport roller does not change during a reverse transport of the recording medium to the sheet reversing portion, wherein friction between a peripheral surface of the at least one roller guide and the recording medium is lower than of the friction between the transport roller and the recording medium, wherein the at least one roller guide and the transport roller are coaxially provided to a same shaft, and the at least one roller guide is rotatable in both forward and reverse directions, independent of a rotation of the transport roller, the at least one roller guide is provided between a plurality of transport rollers and is formed of a low frictional material so as to provide slidability, and a slide member provided between the at least one roller guide and the transport roller to prevent the at least one roller guide and the transport roller from contacting each other.

9. The sheet transport device according to claim 2, wherein the sheet transport claws are urged toward the at least one transport roller.

10. The sheet transport device according to claim 1, further comprising sheet transport claws configured to be pushed in a direction away from the shaft when the sheet recording medium is conveyed to the sheet reversing portion.

11. The sheet transport device according to claim 2, wherein a rotation fulcrum of the sheet transport claws is disposed upstream of the diverging point in a direction of sheet transport when the recording medium enters the sheet reversing portion, and downstream from the diverging point in a direction of sheet transport when the recording medium is switched back after passing through the sheet reversing portion.

12. The sheet transport device according to claim 1, wherein the at least one transport roller does not rotate forward and backward.

13. The sheet transport device according to claim 1, wherein the at least one transport roller always rotates in a same direction.

14. The sheet transport device according to claim 2, wherein the transport claws are disposed on a separate shaft.

15. A sheet transport device, comprising:

a transport roller provided to a diverging point of a sheet reversing portion from which a recording medium enters or exits, configured to transport the recording medium to the sheet reversing portion;

at least one roller guide provided in a vicinity of an end face of at least one side of the transport roller, configured to suppress a curled portion of a corner portion of the recording medium from contacting the transport roller when reversing the recording medium; and a shaft on which the transport roller and the at least one roller guide are disposed, wherein rotation of the transport roller does not change during a reverse transport of the recording medium to the sheet reversing portion, an outer diameter of the at least one roller guide is slightly smaller than the outer diameter of the transport roller that is disposed in the vicinity of the at least one roller guide, the at least one roller guide is provided between a plurality of transport rollers and is formed of a low frictional material so as to provide slidability, and a slide member provided between the at least one roller guide and the transport roller to prevent the at least one roller guide and the transport roller from contacting each other.

* * * * *

UNITED STATES PATENT AND TRADEMARK OFFICE

CERTIFICATE OF CORRECTION

PATENT NO. : 8,326,207 B2
APPLICATION NO. : 12/314311
DATED : December 4, 2012
INVENTOR(S) : Gaman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 629 days.

Signed and Sealed this
Eleventh Day of November, 2014

Michelle K. Lee

Michelle K. Lee
*Deputy Director of the United States Patent and Trademark Office*